United States Patent [19]

Malinowski et al.

[11] Patent Number: 4,790,506

[45] Date of Patent: Dec. 13, 1988

[54] SUPPORT STAND FOR READING MATERIAL

[76] Inventors: Stephen A. Malinowski, 1850 Arch St. #5, Berkeley, Calif. 94709; Douglas C. George, P.O. Box 908, Redway, Calif. 95560

[21] Appl. No.: 86,296

[22] Filed: Aug. 17, 1987

[51] Int. Cl.[4] ..... A47B 23/00

[52] U.S. Cl. ..... 248/441.1; 248/444.1

[58] Field of Search ..... 248/441.1, 444.1, 445, 248/447, 458, 460, 121; 108/92

[56] References Cited

U.S. PATENT DOCUMENTS

| | | | |
|---|---|---|---|
| 230,446 | 7/1880 | Strange | 248/458 X |
| 804,462 | 11/1905 | Fowble | 248/444.1 X |
| 1,244,320 | 10/1917 | Gonnella | 248/458 |
| 1,798,809 | 3/1931 | Randall | 248/458 |
| 2,044,589 | 6/1936 | Morgan | 248/458 |
| 2,104,072 | 1/1938 | Carr | 248/458 |
| 2,359,895 | 10/1944 | Burton | 248/445 |
| 2,707,350 | 5/1955 | Schaffner | 248/458 |
| 2,896,364 | 7/1959 | McCollister | 248/445 |
| 3,103,760 | 9/1963 | Gould | 248/445 |
| 3,318,562 | 5/1967 | Hersh | 248/460 |
| 3,476,348 | 11/1969 | Rustad | 248/444.1 |
| 3,664,629 | 5/1972 | Reed | 248/445 |
| 3,740,015 | 6/1973 | Adams | 248/445 |
| 3,934,806 | 1/1976 | Rady | 248/441.1 |
| 4,313,589 | 2/1982 | Vega | 248/460 X |

FOREIGN PATENT DOCUMENTS

| | | | |
|---|---|---|---|
| 334208 | 1/1936 | Italy | 248/445 |
| 1478012 | 6/1977 | United Kingdom | 248/444.1 |

*Primary Examiner*—J. Franklin Foss
*Assistant Examiner*—Robert A. Olson

[57] ABSTRACT

A support stand for reading material having a transparent plate (10) supported substantially above eye level (82) of a seated or standing reader. The plate is tilted toward the reader such that its front surface is approximately perpendicular to the reader's line of vision. Disposed near the lower edge of the plate on the side opposite the reader is a protruding member (12) which acts as a ledge for the reading material to rest against. Other configurations of this stand may include one or two secondary supporting plates (44 and 58), positioned at or below eye level, these plates being tilted such that their surfaces are also approximately perpendicular to the reader's line of vision and positioned at approximately the same distance from the reader's head.

8 Claims, 4 Drawing Sheets

SUPPORT STAND FOR READING MATERIAL

Background

1. Field of Invention

This invention relates generally to support stands for reading material and specifically to a new and improved modular and expandable stand capable of displaying a large amount of reading material in a convenient and easily viewed position without obstructing existing desk or table space.

2. Background--Disscusion of Prior Art

In certain circumstances, it is desirable to have many articles of reading material simultaneously within view. Heretofore, the surface of a desk or table was commonly used as a support for reading material. To view several documents at once, the reader would spread the reading material over the available surface. There are two significant disadvantages to this approach. First, when pages supported on a flat surface are placed further away from the reader, they become more difficult to read, due to the increased distance and the decreased viewing angle. Second, since this surface space is often needed for writing, drawing, typing and similar activities, it is at a premium; it is therefore disadvantageous to fill it with reading material.

The prior art is replete with disclosures of stands which hold books, manuals, single sheets and other reading material in a manner convenient for persons in various positions. Typically, such stands either sit directly on the surface of a desk, or are supported a short distance above the surface. These stands hold the reading material inclined slightly away from the reader.

However, because they obstruct the workspace, few of these stands, however, significantly augment the support space normally provided by the workspaces of desks, tables, workbenches and the like. Therefore, while these stands may be acceptable when only one or two documents are being viewed, their use become increasingly inconvenient as the number of documents increases.

When several documents need to be viewed often, the reader has little recourse but to repeatedly switch the relative positions of the various pieces of reading material.

For a standing person, many supports for reading material have been invented, such as podiums, lecterns and music stands. However, these provide only a partial solution when the reader requires several documents to be displayed simultaneously.

OBJECTS AND ADVANTAGES

Accordingly, it is one object of our invention to provide a support stand for reading material which:

a. is expandable, allowing different configurations to support varying amounts of reading material per stand, b. incorporates a mounting system that allows a multiplicity of such stands to be attached to a work surface or a separate pedestal, thereby enabling the user to increase the number of support surfaces as needed, c. augments the support space provided by a desk or table without sacrificing any appreciable amount of those work surfaces, d. positions all reading material at the same approximate distance from the user and at an orientation approximately perpendicular to the line of sight, and e. when used in its multi-support surface configuration or when several are used at the same time, is capable of displaying a large number of items simultaneously.

Further objects and advantages of our invention will become apparent from a consideration of the drawings and ensuing description.

DRAWING FIGURES

DESCRIPTION AND OPERATION OF THE INVENTION

A preferred embodiment of our invention is shown in FIGS. 1, 2, 3, 4, 5 and 6. This embodiment of the invention includes three basic configurations, which differ from one another in the number of support surfaces for reading material which they contain.

Single-Plate Configuration—Description

Figure 1:
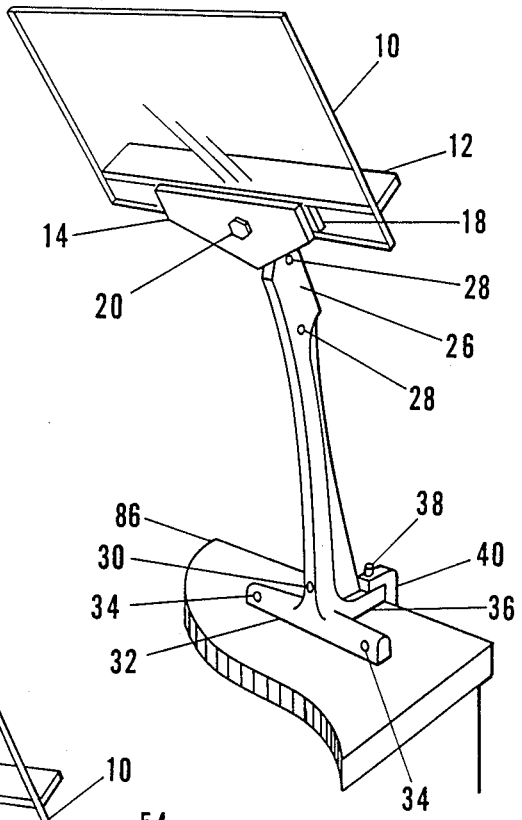
FIG. 1 is a perspective view of the simplest configuration of the stand according to our invention, including only a single support surface.
Figure 5:
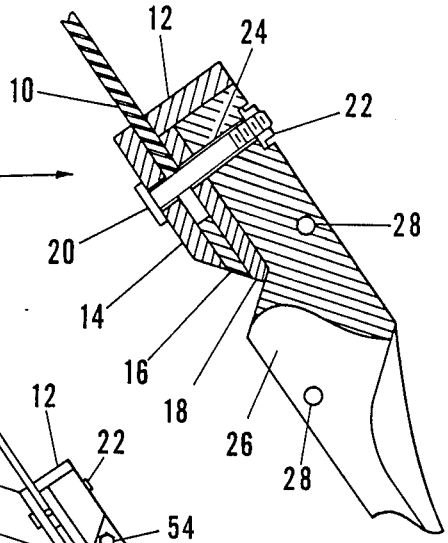
FIG. 5 shows a detail of a clamping mechanism used to hold the uppermost support surface.

The simplest configuration, shown in FIG. 1 and in the crosssectioned area of FIG. 5 comprises a forward tilting, flat, transparent plate 10, a clamping mechanism 90 to hold the plate, a ledge 12 to prevent reading material (not shown) from sliding off plate 10, and a support structure 26 to hold the various parts in the proper position.

Clamping mechanism 90 (detail FIG. 5) holds plate 10 in position. Transparent plate 10 is clamped by a nut 22 and a bolt 20 between a movable front vise jaw 14 on one side and by a non-movable jaw 18 and ledge 12 on the other. Bolt 20 passes through main upright support structure 26 as well as through the vise jaws 14 and 18. A fulcrum spacer block 16, which is the same thickness as the plate 10, is attached by suitable means to or made integral with jaw 18.

Ledge 12 is affixed by suitable means to both the top of upright support structure 26 and the top of non-movable jaw 18.

Support structure 26 has a clearance hole 24 located near its upper end to accept clamping bolt 20. Two clearance holes 28 are located below hole 24. A threaded hole 30 is located near the bottom of support structure 26.

Support structure 26 terminates at its lower end in a lateral foot 32 and a clamping foot 36 which has a swivel pin 38 embedded in it. Lateral foot 32 also contains two clearance holes 34. A C-clamp 40 has a hole 42 (FIG. 6) which fits over swivel pin 38.

Single-Plate Configuration—Operation

The configuration shown in FIGS. 1 and 5 functions to hold reading material (not shown) such as a single open book or manual, or reading material of equivalent size such as two single sheets of paper, in a position which is elevated above eye level for a seated person. This leaves the area below free for other uses. Transparent plate 10 tilts forward toward the reader (not shown) and thus holds the reading material (not shown) at an orientation which is approximately perpendicular to the line of sight. The front surface of the reading material rests on the upper surface of the transparent plate. Thus, the reading material is visible through the transparent plate.

Clamping assembly 90, shown in detail in the sectioned area of FIG. 5, holds transparent plate 10 by clamping it near its bottom edge. The plate is clamped between movable jaw 14 and both nonmovable jaw 18 and ledge 12. The clamping force is provided by bolt 20 and nut 22. Spacer 16 maintains the proper alignment of movable jaw 14 and also serves as a fulcrum which allows nut 22 and bolt 20 to clamp vise jaws 14 and 18 onto plate 10.

Ledge 12 prevents the reading material from sliding off the plate 10. Also, since ledge 12 is rigidly affixed to the top of support structure 26 and to the top edge of jaw 18, it braces plate 10 and jaw 18 and holds them rigid with respect to upright support structure 26.

Main upright support structure 26 serves to hold clamping mechanism 90, and thereby transparent plate 10, in the required elevated position and orientation. This allows the reading material to be easily viewed without sacrificing an appreciable amount of work surface.

Flat bottomed lateral foot 32 prevents the stand from tipping over sideways. Clamping foot 36 provides a protrusion for clamping the stand to a work surface 86 and prevents the stand from tipping over forward when it is so clamped. Pin 38, embedded in foot 36, allows the whole support stand to swivel when clamp 40 is loosened and at the same time prevents the clamp from falling off when it is so loosened. Clearance holes 28 and 34 and threaded hole 30 all function to enable additional support surfaces to be attached as described elsewhere.

Two-Plate Configuration—Description

Figure 2:
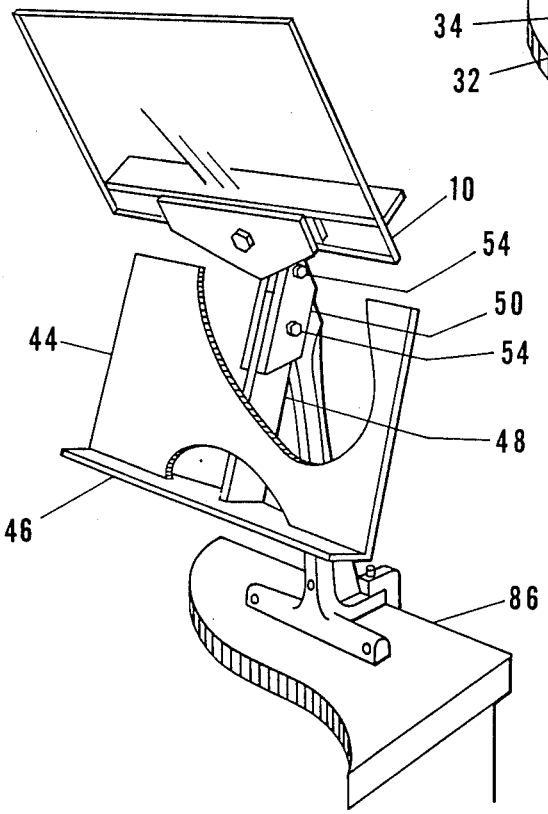
FIG. 2 is a perspective view of a second configuration of the stand showing an added second support surface.
Figure 6:
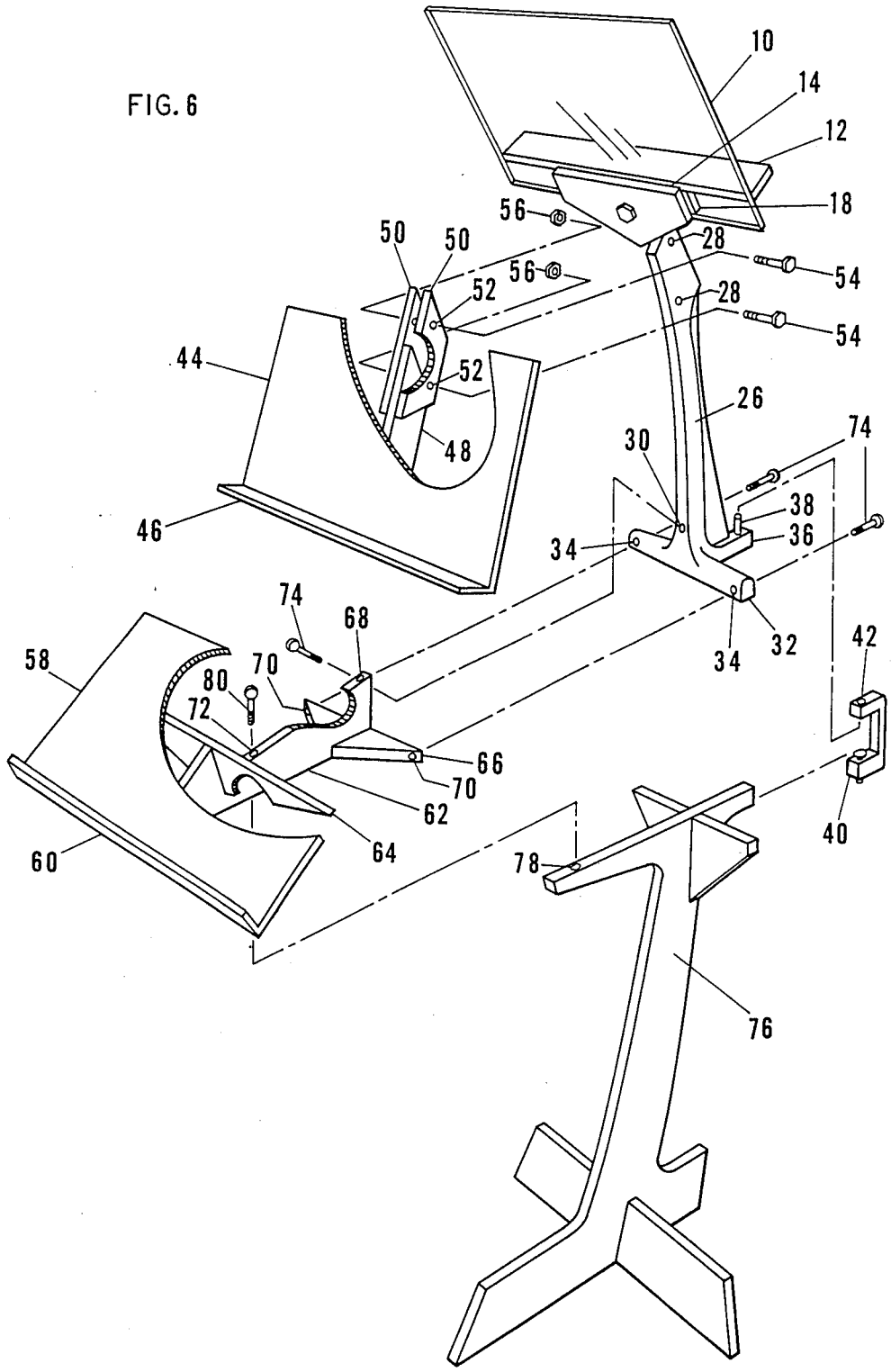
FIG. 6 is an exploded view of the stand, showing how the different configurations are obtained by the addition of the detachable support surface assemblies.

The second configuration of the stand is shown in FIGS. 2 and 6 and comprises the basic single-plate configuration depicted in FIG. 1 plus a second plate 44 and ledge 46 with supporting means.

Ledge 46 is attached to lower edge of plate 44 with appropriate means (not shown) or made integral plate 44. Ledge 46 also extends behind plate 44 and is affixed securely by appropriate means (not shown) to the lower end of arm 48. Two identical attachment plates 50 are affixed permanently by appropriate means to opposite sides of arm 48 at its upper end, as depicted most clearly in FIG. 6. Plates 50 each have two clearance holes 52 positioned to match the pattern and size of holes 28 in upright support structure 26 and to accept assembly bolts 54. As shown in FIG. 6, assembly bolts 54 screw into nuts 56.

Two-Plate Configuration—Operation

The two-plate configuration shown in FIG. 2 holds twice as much reading material as the one-plate configuration shown in FIG. 1. The second support surface in this configuration holds the reading material at approximately the same distance from the user's head as plate 10 and ledge 12, and in an orientation that is approximately perpendicular to the line of sight. This second surface can hold a quantity of reading material roughly the same as that supported by plate 10. This second surface tilts backward, away from the user, and holds the reading material so as to be read from above. As in the first configuration, this arrangement does not sacrifice any appreciable amount of work surface.

Ledge 46 prevents the reading material from sliding off plate 44 and also braces plate 44 to make it rigid relative to arm 48.

Arm 48 and matched plates 50 support plate 44 in its proper orientation and distance from eye position 82 (FIG. 4) and below transparent plate 10 (FIG. 2). As shown in FIG. 6, two sets of aligned holes 52 in plates 50 receive bolts 54 which also pass through holes 28 in upright support 26, and then screw into nuts 56 to reversibly clamp arm 48 to upright support 26.

Three-Plate Configuration—Description

Figure 3:
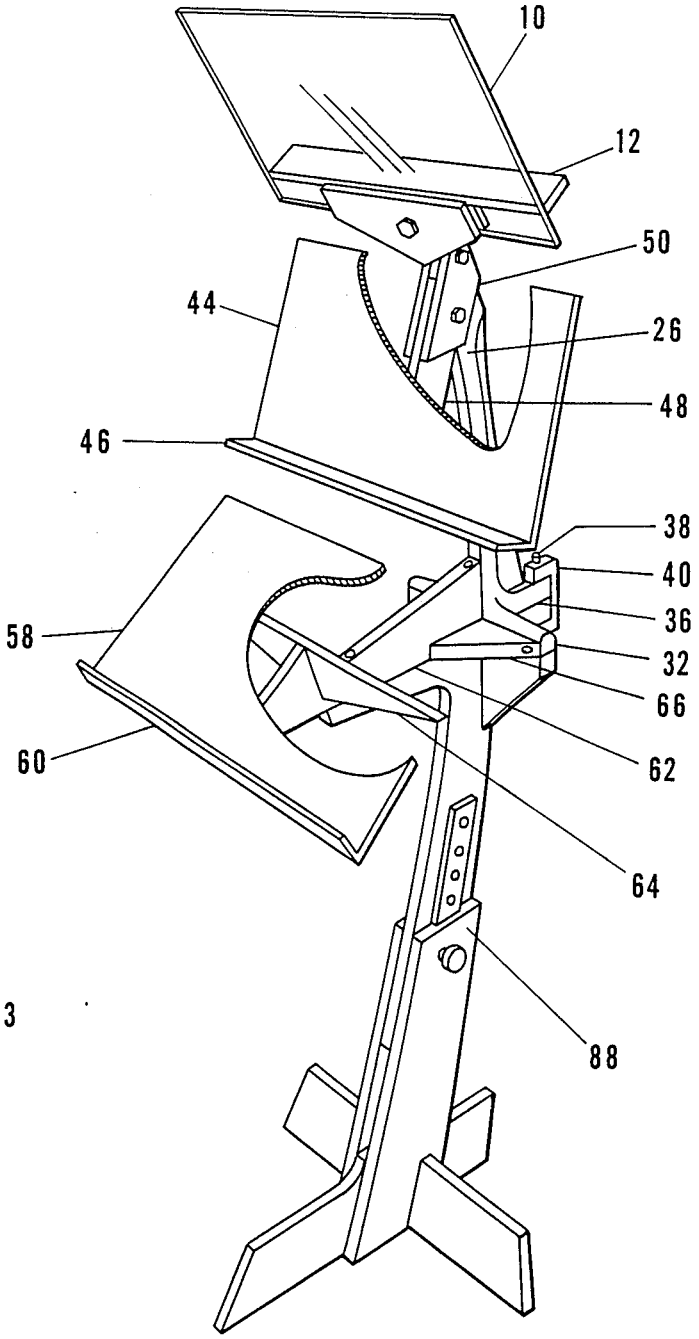
FIG. 3 is a perspective view of a third configuration of the stand showing addded second and third support surfaces.
Figure 4:
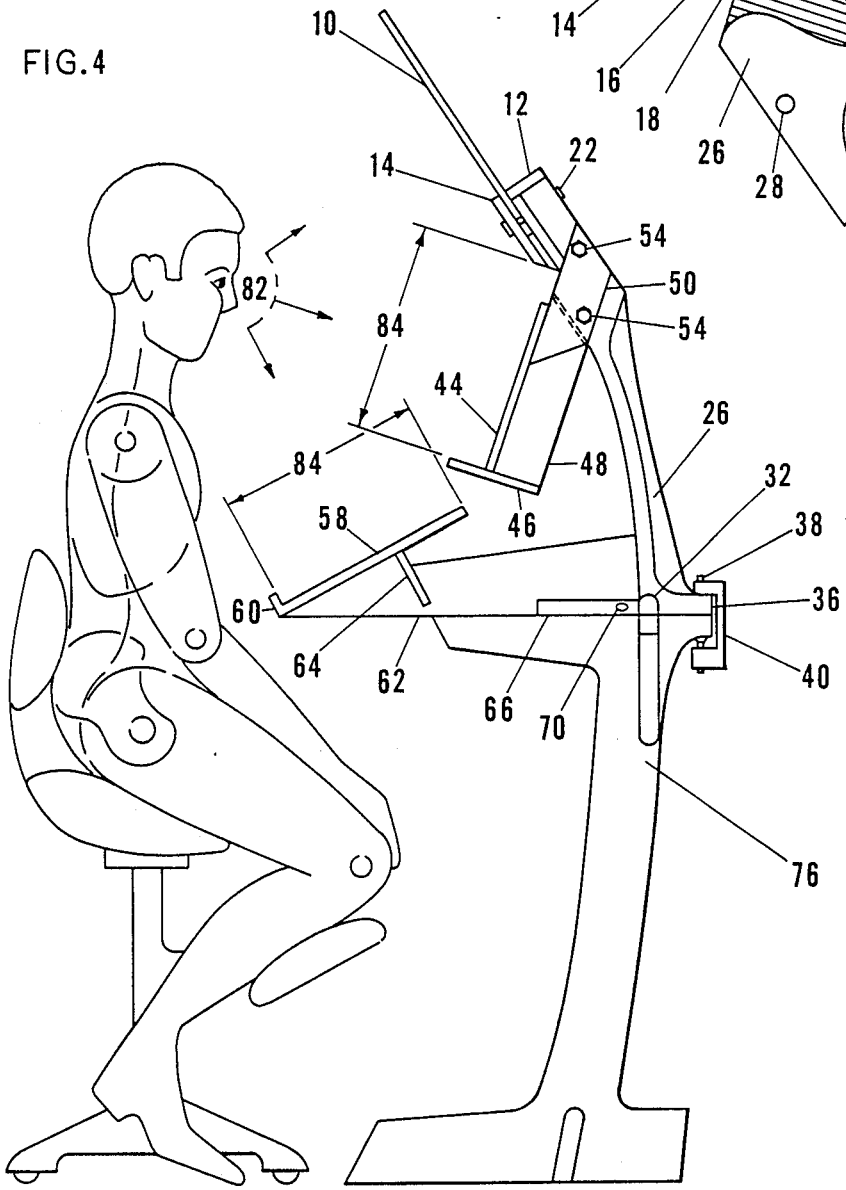
FIG. 4 is a side view of the third configuration; it shows the relationship of the support surfaces to the eye position of the seated person.

The three-plate configuration of the stand is shown in FIGS. 3, 4 and 6 and comprises the two-plate configuration shown in FIG. 2 plus a third plate 58 and ledge 60 with supporting means.

Ledge 60 is attached to the lower edge of plate 58 with appropriate means (not shown) or made integral plate 58.

Plate 58 is permanently affixed by appropriate means to both arm 62 and brace 64. Likewise, braces 64 and 66 are affixed by appropriate means to arm 62. Arm 62 has a threaded clearance hole 68 located on its top edge near the back, and a non-threaded clearance hole 72 in its edge near the middle. Brace 66 has two threaded holes 70, one located near each end as indicated in FIG. 6. Hole 68 and two holes 70 all accommodate assembly screws 74. Threaded hole 72 accommodates assembly screw 80, as indicated in FIG. 6. FIGS. 4 and 6 depict a pedestal 76 with a threaded hole 78 located near the front in the top edge, as shown in FIG. 6. FIG. 3 shows the stand with the inclusion of pedestal 88 which is vertically adjustable by suitable means.

Three-Plate Configuration—Operation

The configuration shown in FIGS. 3, 4 and 6 functions to support three times as much reading material as the single-plate configuration of FIG. 1. As in the two previous versions, it also holds all reading material at approximately the same distance from the user's eye position 82 (FIG. 4) and in an orientation approximately perpendicular to the line of sight.

Plate 58 functions to support the reading material and ledge 60 prevents the reading material from sliding off surface 58.

Arm 62 and two braces 64 and 66 support plate 58 in its proper orientation and position below and in front of plate 44 and maintain the necessary page turning clearance 84, as shown in FIG. 4. Three assembly screws 74 pass through their corresponding clearance holes 34 and 68 and into the corresponding threaded holes 70 and 30 and thereby function to reversibly attach arm 62 to support structure 26. Brace 64 serves to stiffen surface 58 and make it rigid with respect to arm 62.

Brace 66 functions to make arm 62 rigid with respect to upright support structure 26.

FIGS. 4 and 6 show the third configuration mounted to a pedestal 76. FIG. 6 in particular depicts how the third configuration is reversibly attached to the pedestal by means of the assembly screw 80 which passes through hole 72 and into threaded hole 78 located in the top edge of pedestal 76, and by clamp 40. FIG. 3 shows the third configuration mounted to an adjustable pedestal 88 which allows the stand to be used by a standing person as well as by a person who is seated. The manner of attachment to pedestal 88 is the same as that described for pedestal 76. This configuration can alternately be placed directly onto a work surface and clamped thereto as described for the first two configurations. This would, however, result in the loss of space from that work surface.

The document support embodied in this invention consists of an elevated, forward-tilting, transparent support surface, with optional ancillary elevated support surfaces. It thus provides a way for a seated or standing person to conveniently view a large amount of reading matter while freeing desk, table or counter space for other uses.

While the above description contains many specificities, these should not be construed as limitations on the scope of the invention, but rather as an exemplification of one preferred embodiment thereof. Many other variations are possible.

For example, the stand could be fixed to a wall or suspended from the ceiling or built into a study carrel.

Accordingly, the scope of the invention should be determined not by the embodiments illustrated, but by the appended claims and their legal equivalents.

We claim:

1. A support stand for holding reading material above eye level of a seated or standing human, comprising:

a rigid transparent plate having front and back major surfaces and top, bottom, left and right edges, means for supporting said plate such that (a) said plate is substantially above eye level of said seated or standing human, and (c) said plate is inclined from the vertical such that said top edge of said plate is approximately the same distance from said human's head as said bottom edge thereof, means attached to said back major surface for supporting said reading material lying against said back major surface, a second rigid plate, means for holding said second plate below said transparent plate, inclined in the opposite direction as said transparent plate, and means attached to said second plate for supporting reading material lying against said second plate.

2. The support stand of claim 1, further including:

a third rigid plate, means for holding said third plate below said second plate, inclined in the same direction as and to a greater degree than said second plate, and means attached to said third plate for supporting reading material lying against said third plate.

3. The support stand of claim 1, further including means for attaching said stand to a horizontal work surface.

4. The support stand of claim 2 further including means for attaching said stand to a horizontal work surface.

5. The support stand of claim 1 further including means for supporting said stand directly on the floor.

6. The support stand of claim 2 further including means for supporting said stand directly on the floor.

7. The support stand of claim 3, further including means to allow said stand to swivel about a vertical axis.

8. The support stand of claim 4, further including means to allow said stand to swivel about a vertical axis.

* * * * *